US011417478B2

(12) United States Patent
Yaginuma et al.

(10) Patent No.: US 11,417,478 B2
(45) Date of Patent: Aug. 16, 2022

(54) MULTIDIRECTIONAL INPUT APPARATUS WITH SWITCH AND MULTIDIRECTIONAL INPUT SYSTEM WITH SWITCH

(71) Applicant: ALPS ALPINE CO., LTD., Tokyo (JP)

(72) Inventors: Sadayuki Yaginuma, Miyagi (JP); Kunio Hosono, Fukushima (JP); Tetsuo Muranaka, Miyagi (JP); Yasuji Hagiwara, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/305,190

(22) Filed: Jul. 1, 2021

(65) Prior Publication Data

US 2022/0013311 A1 Jan. 13, 2022

(30) Foreign Application Priority Data

Jul. 10, 2020 (JP) ..... JP2020-119462

(51) Int. Cl.
*H01H 13/14* (2006.01)
*H01H 25/04* (2006.01)
*H01H 13/785* (2006.01)

(52) U.S. Cl.
CPC ..... *H01H 25/041* (2013.01); *H01H 13/785* (2013.01); *H01H 2201/032* (2013.01); *H01H 2239/078* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 2215/004; H01H 25/008; H01H 25/041; H01H 2239/052; G06F 3/0338
See application file for complete search history.

(56) References Cited

U.S. PATENT DOCUMENTS

2015/0200063 A1* 7/2015 Chuang ..... H01H 13/14 200/341
2017/0194114 A1* 7/2017 Towers ..... H01H 13/14
2017/0263114 A1* 9/2017 Yoon ..... G08C 17/02

FOREIGN PATENT DOCUMENTS

JP 2003-036131 2/2003

* cited by examiner

*Primary Examiner* — Ahmed M Saeed
(74) *Attorney, Agent, or Firm* — IPUSA, PLLC

(57) ABSTRACT

A multidirectional input apparatus with a switch includes a strain generating body including at least a cylindrical portion and a first plate portion; a plurality of strain sensors; a wiring substrate; a contact rubber configuring the switch together with an electrode on the wiring substrate; and a button. The contact rubber includes a base portion, a movable portion, and a deformable portion. The movable portion is movable to a first position when the deformable portion is not deformed, and to a second position when the deformable portion is deformed. A center of a lower surface of the button contacts an upper surface of the movable portion when the movable portion is at the first and second positions. When the movable portion moves from the first position to the second position and contacts the electrode, a protruding portion on the lower surface of the button presses the wiring substrate.

15 Claims, 9 Drawing Sheets

MULTIDIRECTIONAL INPUT APPARATUS WITH SWITCH AND MULTIDIRECTIONAL INPUT SYSTEM WITH SWITCH

CROSS-REFERENCE TO RELATED APPLICATION

The present application is based on and claims priority under 35 U.S.C. § 119 to Japanese Patent Application No. 2020-119462, filed on Jul. 10, 2020, the contents of which are incorporated herein by reference in their entirety.

BACKGROUND OF THE INVENTION

1. Field of the Invention

The present invention relates to a multidirectional input apparatus with a switch and a multidirectional input system with a switch.

2. Description of the Related Art

Conventionally, there is an input apparatus with switch that includes a lever member including a strain resistance element, a switch including a movable contact point and a fixed contact point, a first operation portion configured to operate the lever member, a second operation portion configured to operate the switch, and a return spring configured to bias the second operation portion in one direction. In a non-operated state, the second operation portion protrudes outward from a part of the first operation portion due to an elastic force of the return spring. In an operated state, the second operation portion is pressed into the first operation portion by an operator's finger and the first operation portion can be operated by the operator's finger (see, for example, Patent Document 1).

[Patent Document 1] Japanese Laid-open Patent Publication No. 2003-036131

SUMMARY OF THE INVENTION

According to one aspect of the present invention, there is provided a multidirectional input apparatus with a switch including a strain generating body including at least a cylindrical portion and a first plate portion provided under the cylindrical portion; a plurality of strain sensors provided at the first plate portion; a wiring substrate mounted on the cylindrical portion of the strain generating body; a contact rubber mounted on the wiring substrate and configuring the switch together with an electrode on the wiring substrate; and a button mounted on the contact rubber, wherein the contact rubber includes a base portion positioned on a periphery of the contact rubber, a movable portion positioned at a center of the contact rubber, and a deformable portion linking the base portion and the movable portion, wherein the movable portion is movable to a first position with respect to the base portion in a state where the deformable portion is not deformed, and to a second position with respect to the base portion in a state where the deformable portion is deformed, a center of a lower surface of the button contacts an upper surface of the movable portion of the contact rubber when the movable portion is at the first position or the second position, and when the movable portion moves from the first position to the second position and a lower surface of the movable portion contacts the electrode on the wiring substrate, a protruding portion provided on a periphery of the lower surface of the button presses the wiring substrate.

DETAILED DESCRIPTION OF THE PREFERRED EMBODIMENTS

The above-described conventional input apparatus with switch is difficult to be downsized, because the part touched when operating the second operation portion and the part touched when operating the first operation portion are different.

Therefore, an object of the present invention is to provide a multidirectional input apparatus with switch and a multidirectional input system with switch that are downsized.

Hereinafter, an embodiment in which a multidirectional input apparatus with switch and a multidirectional input system with switch are applied, will be described.

Embodiments

Figure 1:
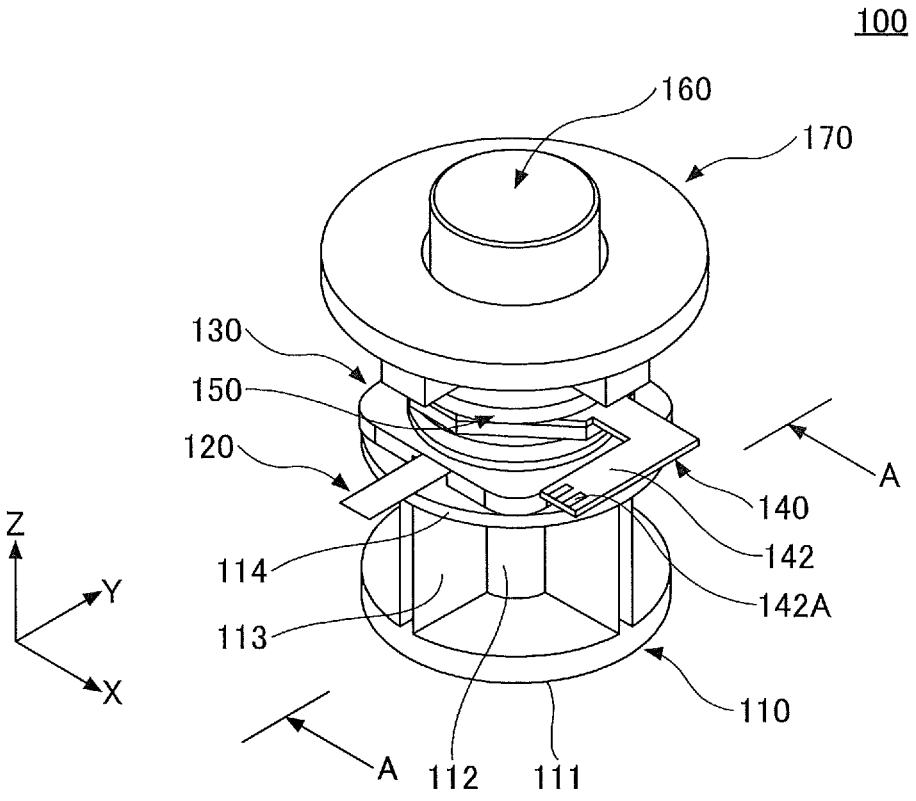
FIG. 1 is a diagram illustrating a multidirectional input apparatus with switch according to an embodiment.
Figure 2:
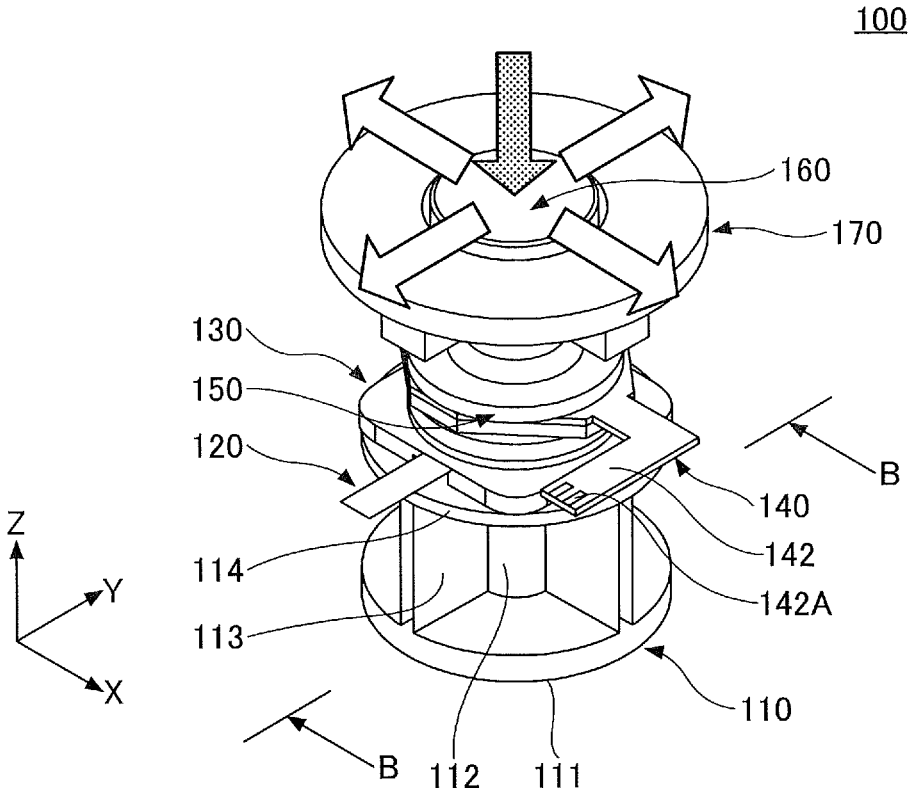
FIG. 2 is a diagram illustrating an operation state of the multidirectional input apparatus with switch.
Figure 3:
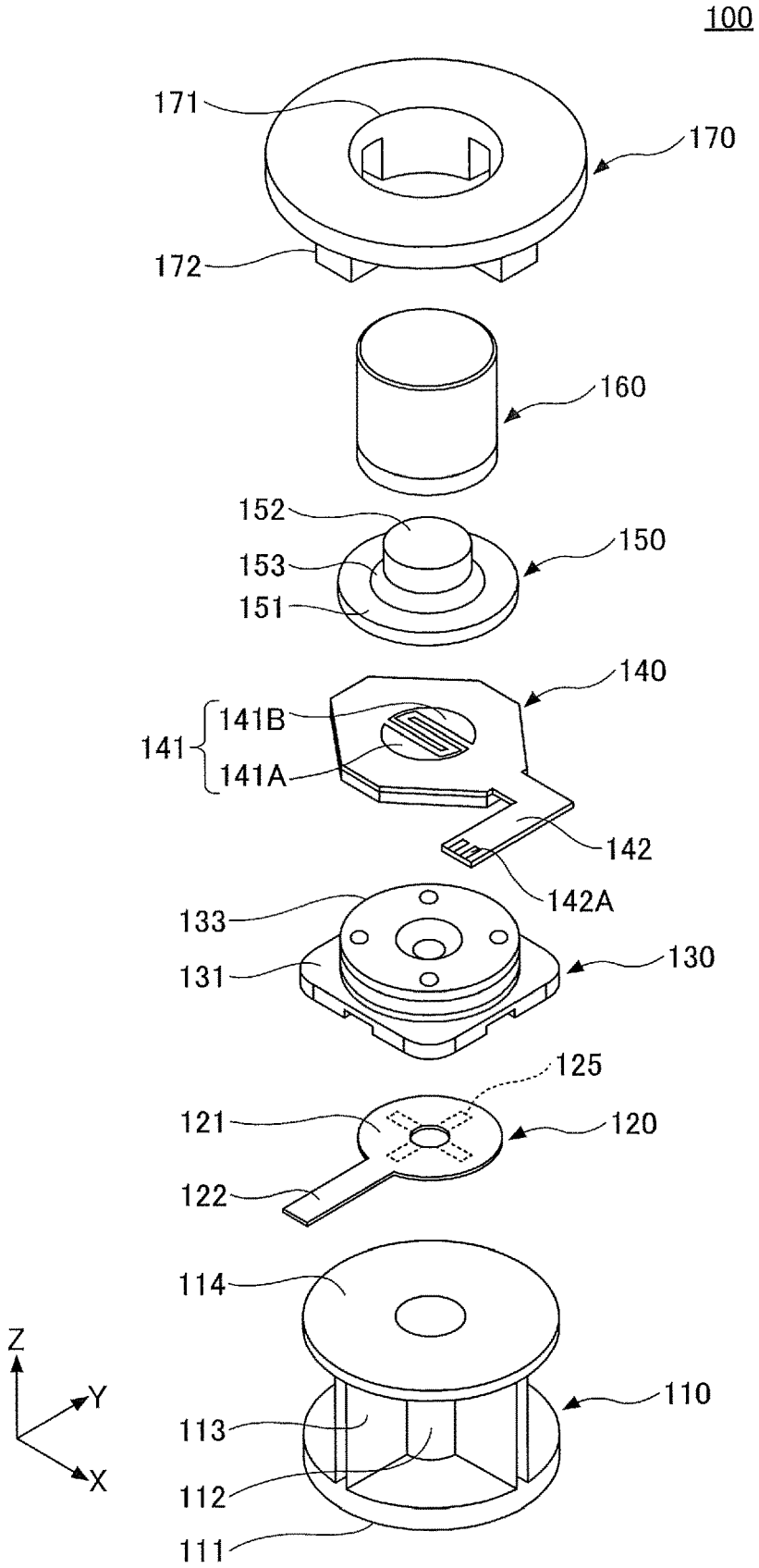
FIG. 3 is an exploded view illustrating the multidirectional input apparatus with switch.
Figure 4:
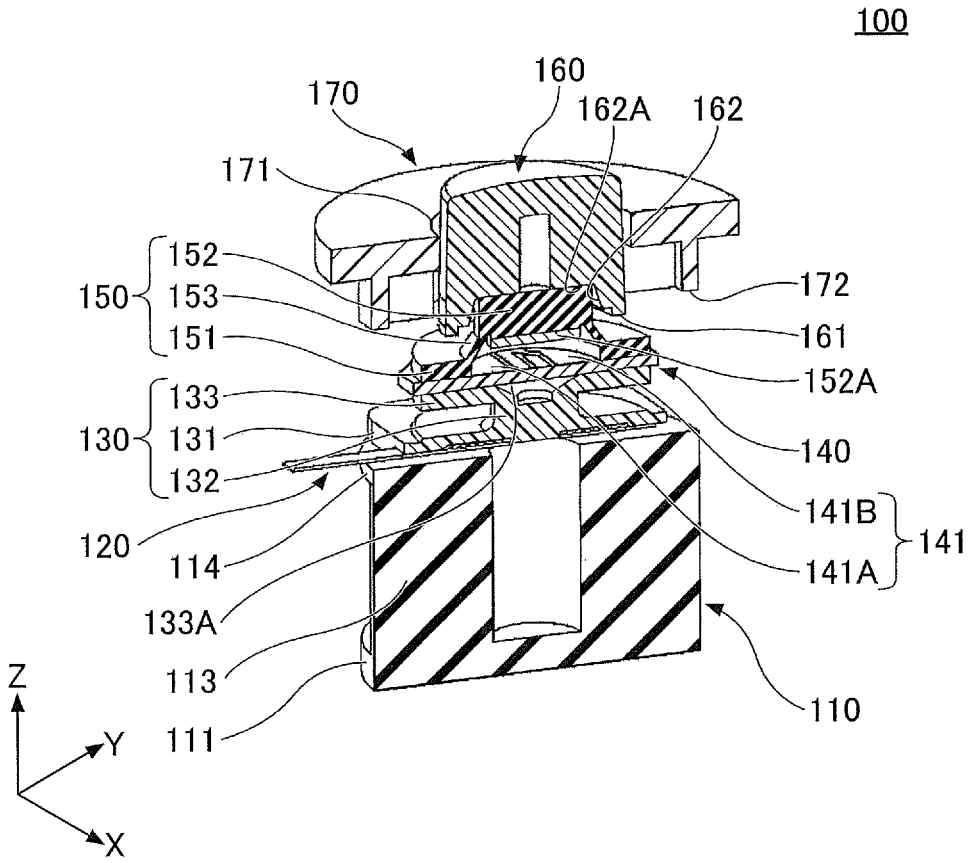
FIG. 4 is a cross-sectional view cut along a plane viewed from a direction of arrows A-A of FIG. 1.
Figure 5:
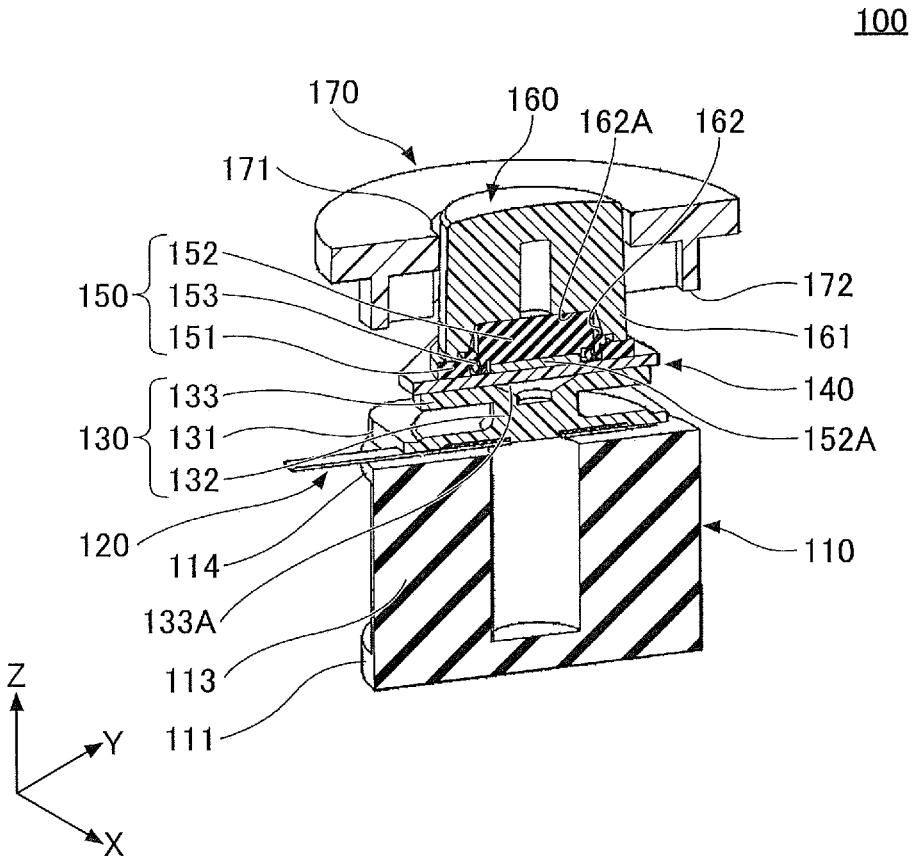
FIG. 5 is a cross-sectional view cut along a plane viewed from a direction of arrows B-B of FIG. 2.
Figure 6:
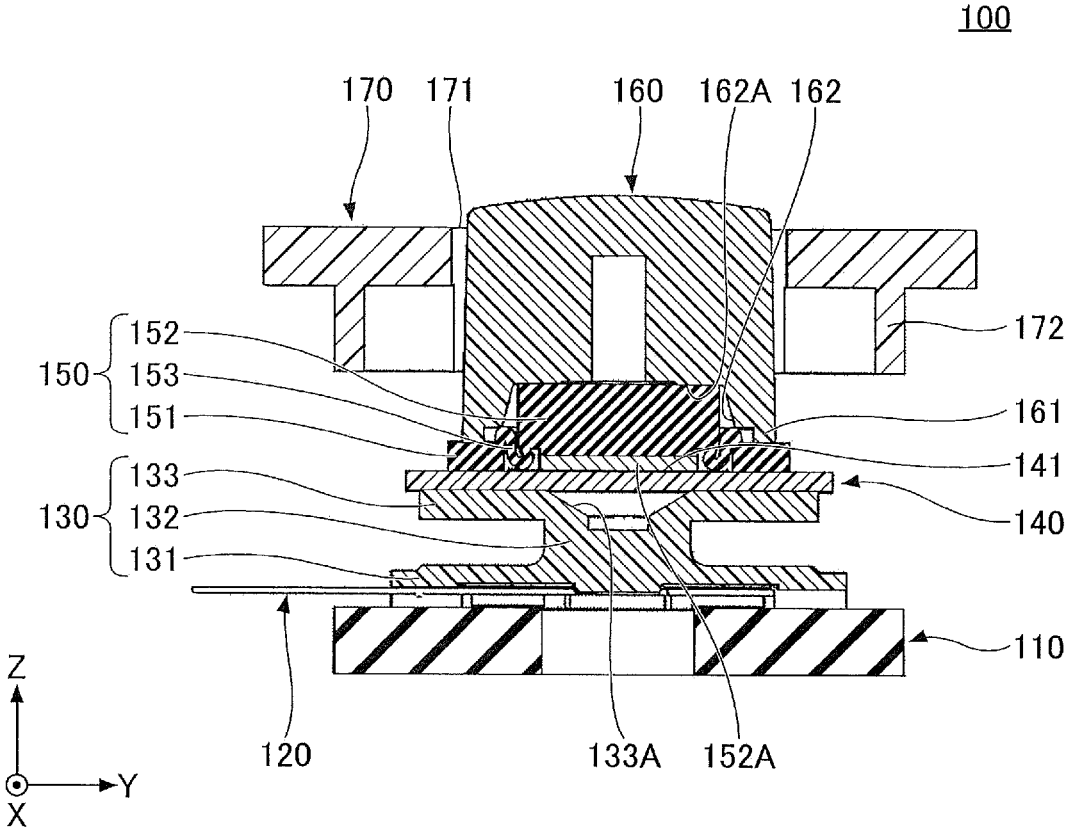
FIG. 6 is a cross-sectional view cut along a plane viewed from a direction of arrows B-B of FIG. 2.

FIG. 1 is a diagram illustrating a multidirectional input apparatus with switch 100 according to an embodiment. FIG. 2 is a diagram illustrating an operation state of the multidirectional input apparatus with switch 100. FIG. 3 is an exploded view illustrating the multidirectional input apparatus with switch 100. FIG. 4 is a cross-sectional view cut along a plane viewed from a direction of arrows A-A of FIG. 1. FIGS. 5 and 6 are cross-sectional views cut along a plane viewed from a direction of arrows B-B of FIG. 2.

The XYZ coordinate system will be defined and described below. In the following, a planar view refers to a XY plane view. For the sake of explanation, the −Z direction side is referred to as the lower side or below, and the +Z direction side is referred to as the upper side or above, but these expressions do not represent a universal vertical relationship.

The multidirectional input apparatus with switch 100 includes a holding portion 110, an FPC (Flexible Printed Circuit Board) 120, a strain detecting element 125, a lever 130, a PCB (Printed Circuit Board) 140, a contact rubber 150, a button 160, and a cover 170.

The multidirectional input apparatus with switch 100 may be attached to any type of electronic device, such as a game machine, a video camera, and the like. The holding portion 110 and the cover 170 are part of a housing of an electronic device. The FPC 120, the strain detecting element 125, the lever 130, the PCB 140, the contact rubber 150, and the button 160 are configured such that the positions thereof are prevented from being shifted in a state of being fixed to the housing of the electronic device. Here, the multidirectional input apparatus with switch 100 that is in a state of being attached to the electronic device will be described, without describing or illustrating the electronic device.

As illustrated in FIG. 2, the multidirectional input apparatus with switch 100 is an apparatus in which the button 160 can be first pressed down as indicated by the black arrow, and in a state where the button 160 is completely pressed down, a pressing operation can be performed to press the button 160 in a planar direction as indicated by the white arrows, and also, in a state where the button 160 is completely pressed down, a pressing operation can be performed to further press the button 160 downward. FIG. 2 illustrates four white arrows representing a ±X direction and a ±Y direction in order to indicate a pressing operation in a planar direction. However, it is possible to perform a pressing operation of pressing the button 160 in any direction in 360 degrees in a planar view. The configuration of each portion will be described below.

The holding portion 110 includes a pedestal 111, a cylindrical portion 112, reinforcing plates 113, and a top plate 114. The pedestal 111 and the top plate 114 are annular plate-like portions with the cylindrical portion 112 and the reinforcing plates 113 provided therebetween. As an example, four reinforcing plates 113 are provided on the outer periphery of the cylindrical portion 112 at equal intervals in a planar view to reinforce the part between the pedestal 111 and the top plate 114.

The FPC 120 is an example of a flexible wiring substrate having a base portion 121 and a wiring portion 122. The FPC 120 is, for example, a polyimide film substrate. The base portion 121 is annular and is provided on the upper surface of the top plate 114 of the holding portion 110. The base portion 121 is adhered to the lower surface of the lever 130. The wiring portion 122 extends from the base portion 121 in the —Y direction, and a part of the wiring portion 122 that is close to the base portion 121 is provided on the upper surface of the top plate 114 of the holding portion 110.

The strain detecting element 125 is an example of a strain sensor. Four strain detecting elements 125 are provided on the lower surface of the base portion 121 of the FPC 120. The four strain detecting elements 125 each have a longitudinal direction, and are arranged on the lower surface of the annular base portion 121 such that the adjacent strain detecting elements 125 extend in different directions from each other by 90 degrees in a planar view. As an example, two of the strain detecting elements 125 extend in the X direction and the other two of the strain detecting elements 125 extend in the Y direction.

The strain detecting element 125 is, for example, a resistive strain sensor configured by a layered body of elastic conductive layers realized by nanocarbon, and is printed on the lower surface of the base portion 121. When the strain detecting element 125 is stretched in the longitudinal direction due to the distortion of the lever 130 associated with a pressing operation on the button 160, the resistance value of the strain detecting element 125 increases. Conversely, when the strain detecting element 125 is contracted in the longitudinal direction, the resistance value of the strain detecting element 125 decreases.

The four strain detecting elements 125 are connected by wirings connected to form a bridge circuit on the lower surface of the FPC 120, and the wirings extend to the end portion of the wiring portion 122. The electronic device is provided with a mainboard (not illustrated). The wiring of the FPC 120 is connected to the main board of the electronic device. The wiring is made by printing silver paste on the lower surface of the FPC 120, for example. This is to provide flexibility to the wiring itself. Note that the strain detecting element 125 is not limited to having such a configuration, and other configurations may be used. The wiring is not limited to a silver paste printed on the FPC 120.

The lever 130 is an example of a strain generating body, including a first plate portion 131, a cylindrical portion 132, and a second plate portion 133, and is made of resin, for example.

The first plate portion 131 is a plate-like member having a rectangular shape in a planar view and has a disc-like protruding portion on the upper surface thereof. The cylindrical portion 132 is connected to the center of the upper surface of the first plate portion 131. The first plate portion 131 is disposed on the upper surface of the top plate 114 of the holding portion 110 and on the upper surface of the FPC 120. On the lower surface of the first plate portion 131, a recess portion corresponding to a step between the upper surface of the top plate 114 and the upper surface of the FPC 120 is provided, so that the FPC 120 can be stably disposed between the first plate portion 131 and the top plate 114. The FPC 120 is adhered to the lower surface of the first plate portion 131. When the first plate portion 131 is deformed, the strain detecting element 125 is also deformed, and the resistance value of the strain detecting element 125 changes. The first plate portion 131 does not need to have a disk-shaped protruding portion on the upper surface.

The cylindrical portion 132 is a portion that is thinner than the first plate portion 131 and the second plate portion 133 in a planar view, and has a cylindrical shape, for example. The cylindrical portion 132 has a cylindrical shape, and, therefore, the second plate portion 133 can be easily tilted with respect to the first plate portion 131 by an equal operating force in any direction in 360 degrees in a planar view.

The second plate portion 133 is a disk-like portion connected to the top of the cylindrical portion, and has a recess portion 133A recessed downwardly in the center of the upper surface. The size of the second plate portion 133 in a planar view is substantially equal to the disk-like protruding portion of the upper surface of the first plate portion 131. The upper surface of the second plate portion 133 contacts the lower surface of the PCB 140. The upper surface of the second plate portion 133 may be adhered to the lower surface of the PCB 140.

The center of the lower surface of the second plate portion 133 is connected to the cylindrical portion 132. The second plate portion 133 is tilted with respect to the first plate portion 131 when the button 160 is pressed in the planar direction in a state where the button 160 is completely pressed down. The second plate portion 133 has the recess portion 133A, and, therefore, the second plate portion 133 has a structure that is easily tilted with respect to the first plate portion 131. When the second plate portion 133 is tilted with respect to the first plate portion 131, the first plate portion 131 is deformed and the resistance value of the strain detecting element 125 changes.

When a pressing operation in the planar direction is performed with respect to the button 160 in a state where the button 160 is pressed down completely, the resistance values of the four strain detecting elements 125 change and the output of the bridge circuit including the four strain detecting elements 125 changes. By detecting a change in the output of the bridge circuit with a microcomputer or the like, it is possible to detect the direction, in 360 degrees in the planar direction, in which the pressing operation has been performed.

Further, when a pressing operation is performed to further press the button 160 downward in a state where the button 160 is pressed down completely, the center portion of the first plate portion 131 is pressed downward through the cylindrical portion 132. As a result, a downward pressing force is applied to the center portion of the first plate portion 131, and the first plate portion 131 is deformed. Because the base portion 121 of the FPC 120 is distorted so that the center side thereof is drawn downwardly, the length of four strain detecting elements 125 provided on the lower surface of the FPC 120 increases. As the length of the four strain detecting elements 125 increases, all of the resistance values of the four strain detecting elements 125 are increased. Therefore, when all of the resistance values of the four strain detecting elements 125 are increased, it is possible to detect, by a microcomputer or the like, that a downward pressing operation has been performed.

Here, a mode in which the lever 130 includes the second plate portion 133 is described, but the lever 130 need not include the second plate portion 133. In such a case, the upper end of the cylindrical portion 132 is to come into contact with the lower surface of the PCB 140.

The PCB 140 is an example of a wiring substrate, such as a wiring substrate of the FR4 (Flame Retardant type 4) standard. The PCB 140 has an electrode 141 at the center of the upper surface thereof. The electrode 141 includes electrode portions 141A and 141B. The electrode portion 141A and the electrode portion 141B are examples of a first electrode portion and a second electrode portion, respectively. Between the electrode portions 141A and 141B, there is an S-shaped break. That is, the electrode portions 141A and 141B are comb-shaped and are shaped to have interdigitated teeth. The electrode portions 141A and 141B are connected to wirings (not illustrated) of the PCB 140. Further, the PCB 140 includes a wiring portion 142. The wiring portion 142 extends in the +X direction and is bent in the −Y direction. A terminal 142A is provided at the leading end of the wiring portion 142. The terminal 142A of the wiring portion 142 of the PCB 140 is connected to a wiring of the main board (not illustrated).

The contact rubber 150 is a member made of rubber and includes an annular base portion 151 positioned on the periphery thereof, a movable portion 152 positioned at the center thereof, and a deformable portion 153. The base portion 151 contacts the upper surface of a periphery portion around the electrode 141 on the upper surface of the PCB 140.

The movable portion 152 is thicker than the base portion 151 and the deformable portion 153, and includes a conductive rubber portion 152A at the lower end thereof. The conductive rubber portion 152A is positioned at the lower end of the movable portion 152, and is made of conductive rubber including carbon particles. The conductive rubber portion 152A can be integrally fabricated with the movable portion 152 by two-color molding.

The movable portion 152 is held by the deformable portion 153 with respect to the base portion 151 and is movable in the vertical direction with respect to the base portion 151. As illustrated in FIG. 4, the position of the movable portion 152, in a state where the button 160 is not operated to be pressed down and the deformable portion 153 is not deformed, is an example of a first position. When the movable portion 152 is at the first position, the conductive rubber portion 152A is not in contact with the electrode 141. Further, when the movable portion 152 is at the first position, a protruding portion 161 at the lower end of the button 160 is not in contact with the upper surface of the base portion 151, and a bottom surface 162A of a recess portion 162 of the button 160 is in contact with the upper surface of the movable portion 152.

The position of the movable portion 152, in a state where the button 160 is completely pressed down from the state where the movable portion 152 is at the first position and the deformable portion 153 is completely deformed as illustrated in FIGS. 5 and 6, is an example of a second position. When the movable portion 152 is at the second position, the conductive rubber portion 152A is in contact with the electrode 141 and the protruding portion 161 at the lower end of the button 160 is in contact with the upper surface of the base portion 151. When the movable portion 152 is at the second position, the movable portion 152 is slightly crushed in the vertical direction, so that the protruding portion 161 contacts the upper surface of the base portion 151. In this manner, the movable portion 152 is slightly crushed in the vertical direction at the second position. Therefore, by making the movable portion 152 have a thickness that is greater than that of the base portion 151 and making the movable portion 152 have a certain thickness, a configuration in which the protruding portion 161 contacts the upper surface of the base portion 151 when the button 160 is pressed down and then further pressed downward, can be realized. Further, considering the dimensional tolerance when manufacturing the contact rubber 150, the movable portion 152 is required to contract in the up and down direction (the vertical direction) by an amount corresponding to the dimensional tolerance or more. Therefore, from this viewpoint also, it is preferable that the thickness of the movable portion 152 is greater than that of the base portion 151, and the movable portion 152 has a certain thickness.

Further, when the movable portion 152 is at the second position, the button 160 is in a state where the protruding portion 161 is connected to the upper surface of the PCB 140 through the base portion 151, and the button 160 is positioned at a lower end of a movable stroke in a vertical direction. Further, when the movable portion 152 is at the second position, the bottom surface 162A of the recess portion 162 of the button 160 is in contact with the upper surface of the movable portion 152.

Further, when the button 160 is further pressed from the state where the movable portion 152 is at the second position, the movable portion 152 is elastically deformed, and, therefore, when the button 160 is pressed down to the lower end of the stroke and is further pressed, the soft feel is transmitted to the operator due to the elastic deformation of the base portion 151.

The deformable portion 153 is a portion linking the base portion 151 and the movable portion 152, and is annular and is thinner than the base portion 151 and the movable portion 152. Therefore, the deformable portion 153 can be deformed from a non-deformed state as illustrated in FIG. 4 to a completely deformed state as illustrated in FIG. 5. In the state illustrated in FIG. 5, the deformable portion 153 is reversed so that the inner peripheral portion thereof connected to the movable portion 152 sinks downward with respect to the outer peripheral portion thereof connected to the base portion 151. The deformable portion 153 has restoration properties (springiness) and can be restored to the state illustrated in FIG. 4 when the pressing operation on the button 160 is released from the state in which the button 160 is completely deformed as illustrated in FIG. 5. The state in which the deformable portion 153 is not deformed corresponds to the state in which the shape of the deformable portion 153 is maintained in the state when the contact rubber 150 had been molded.

The button 160 is mounted on the contact rubber 150 and is for example a cylindrical member. The button 160 is, for example, made of resin, and includes the protruding portion 161 that protrudes in the downward direction from the lower surface thereof at the outermost side in the radial direction, and the recess portion 162 that is recessed in the upward direction from the lower surface thereof.

As described above, the protruding portion 161 contacts the upper surface of the base portion 151 when the movable portion 152 is at the second position. In this state, the movable portion 152 is slightly crushed in the vertical direction. The protruding portion 161 presses the PCB 140 through the base portion 151, and, therefore, a soft feel can be provided when the button 160 is pressed further in a planar direction or a downward direction from the state where the movable portion 152 is at the second position.

The recess portion 162 is recessed in the upward direction from the lower surface of the button 160 so that the bottom surface 162A, which is the bottom surface of the recess portion 162, faces downward. The bottom surface 162A is part of the lower surface of the button 160 and the recess portion 162 is positioned at the center of the button 160 in a planar view, and, therefore, the bottom surface 162A is at the center of the lower surface of the button 160.

The recess portion 162 is circular (in a bottom view) when viewing the button 160 from the lower surface side. The movable portion 152 is accommodated within the recess portion 162, and, therefore, the radial size of the recess portion 162 is larger than the radial size of the movable portion 152. The movable portion 152 expands radially when pressed at the second position, and, therefore, the radial size of the recess portion 162 has a margin with respect to the radial size of the movable portion 152.

The movable portion 152 is accommodated within the recess portion 162, and the bottom surface 162A contacts the upper surface of the movable portion 152 in all of the states, that is, when the movable portion 152 is at the first position, when the movable portion 152 is between the first position and the second position, and when the movable portion 152 is at the second position.

The cover 170 is a member that is annular in a planar view, and includes an opening portion 171 and a leg portion 172. The opening portion 171 vertically penetrates the center of the cover 170. The button 160 is inserted into the opening portion 171. The leg portion 172 extends downwardly from the lower surface of the cover 170. The cover 170 as described above is fixed to a housing or the like of an electronic device to which the multidirectional input apparatus with switch 100 is attached.

As described above, in the multidirectional input apparatus with switch 100, in a state where the button 160 is completely pressed down and the electrode portions 141A and 141B of the electrode 141 are electrically connected, by further pressing the button 160 in a planar direction or a downward direction, it is possible to select any direction in 360 degrees in the planar direction or a downward direction. The operation of electrically connecting the electrode portions 141A and 141B and the operation of selecting any direction in 360 degrees in the planar direction or a downward direction, can be accomplished by operating one button 160. Therefore, there is no need to provide two switches, and downsizing is possible.

Accordingly, the multidirectional input apparatus with switch 100 that is downsized can be provided. Further, two kinds of operations can be performed with one button 160 without the need to provide two switches, and, therefore, the appearance can be simplified.

For example, when the above-described multidirectional input apparatus with switch 100 is used as a controller of a game machine, by pressing down the button 160 completely, operations such as throwing a ball (baseball), kicking a ball (soccer), hitting a ball (golf) and the like can be performed, and an operation of causing the ball to curve in left and right directions can be performed by a pressing operation in left and right directions and an operation of causing the ball to curve in upward or downward directions can be performed by a pressing operation in upward or downward directions. Further, the ball may be prevented from decelerating by a downward pressing operation. Further, in the case where the multidirectional input apparatus with switch 100 is used as a controller of a video camera, when recording is started by pressing down the button 160 completely, and recording is continued by continuously pressing down the button 160, zooming in and out (back and forth) can be performed by a pressing operation in a back and forth direction, and the sensitivity of a microphone can be changed by a pressing operation in the left and right direction.

Figure 7:
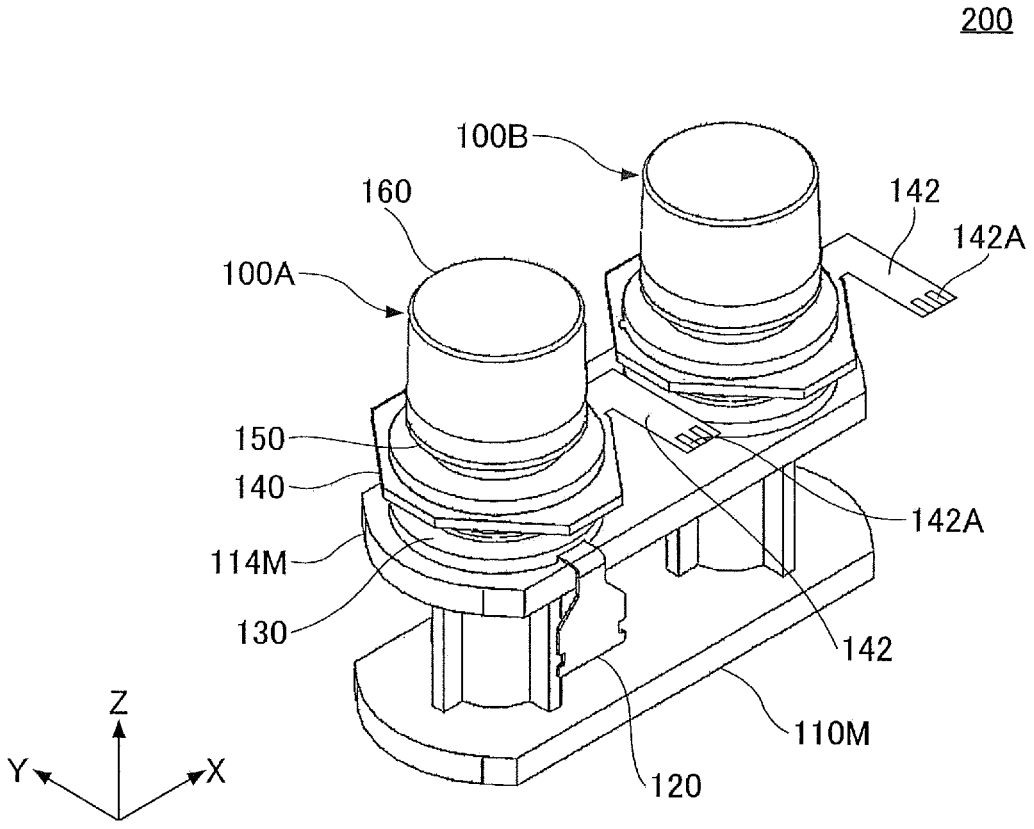
FIG. 7 is a diagram illustrating a multidirectional input system with switch.
Figure 8A:
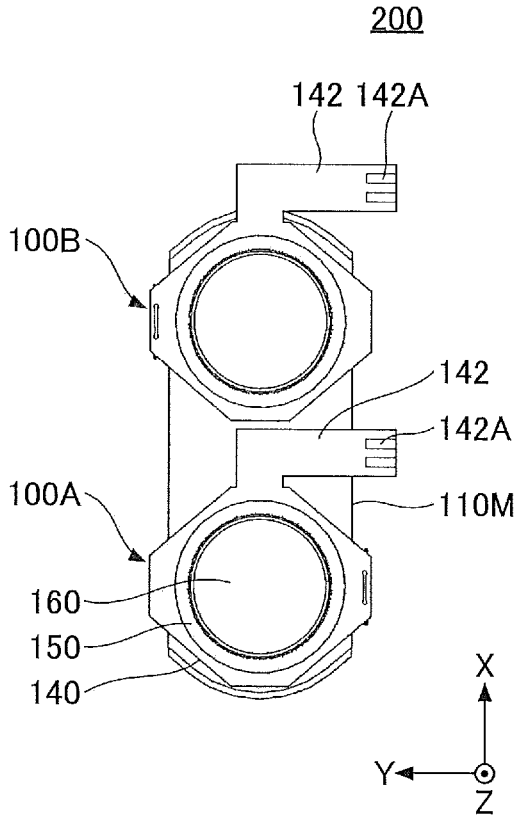
FIGS. 8A to 8C are diagrams illustrating the multidirectional input system with switch.
Figure 8B:
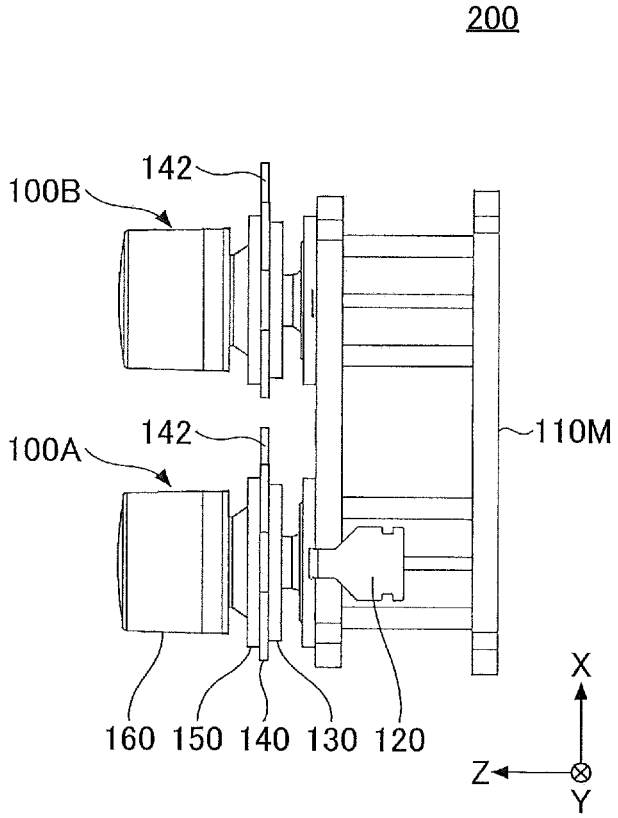
Figure 8C:
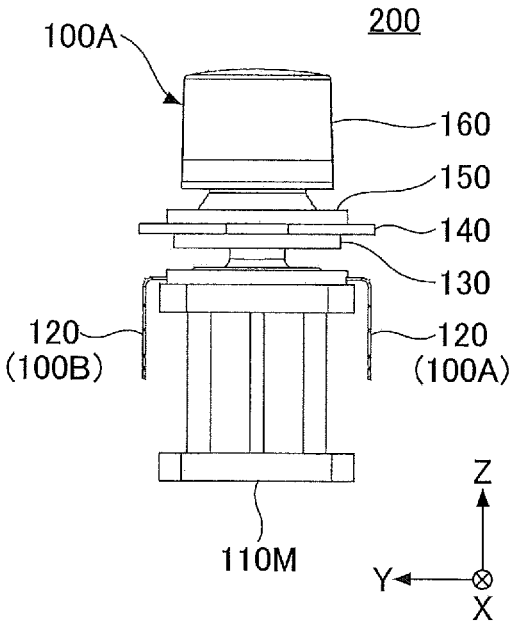

Although the above describes a mode in which the multidirectional input apparatus with one switch 100 is attached to an electronic device, the multidirectional input apparatus with multiple switches 100 may be attached. Here, a multidirectional input system with switch 200 including a plurality of multidirectional input apparatuses with switch will be described. FIGS. 7 to 8C illustrate the multidirectional input system with switch 200.

The multidirectional input system with switch 200 includes a first multidirectional input apparatus with switch 100A and a second multidirectional input apparatus with switch 100B. The first multidirectional input apparatus with switch 100A and the second multidirectional input apparatus with switch 100B are similar to the multidirectional input apparatus with switch 100 illustrated in FIGS. 1 to 6, but are modularized by a common substrate 114M. In FIGS. 7 to 8C, the cover 170 is omitted, but the cover 170 may be shared by the first multidirectional input apparatus with switch 100A and the second multidirectional input apparatus with switch 100B. A holding portion 110M is shared by the first multidirectional input apparatus with switch 100A and the second multidirectional input apparatus with switch 100B, and the portion corresponding to the top plate 114 is configured by the common substrate 114M.

The first multidirectional input apparatus with switch 100A and the second multidirectional input apparatus with switch 100B have separate elements with respect to the FPC 120, the strain detecting element 125, the lever 130, the PCB 140, the contact rubber 150, and the button 160, in view of preventing malfunction. In the above-described multidirectional input system with switch 200, in each of the two apparatuses, that is, in each of the first multidirectional input apparatus with switch 100A and the second multidirectional input apparatus with switch 100B, the operation of causing the electrode portions 141A and 141B to be electrically connected and the operation of selecting any direction in 360 degrees in the planar direction or a downward direction, can be accomplished by operating one button 160. Therefore, it is not necessary to provide two types of switches, and downsizing is possible.

Accordingly, a downsized multidirectional input system with switch 200 can be provided. Further, in each of the two apparatuses, that is, in each of the first multidirectional input apparatus with switch 100A and the second multidirectional input apparatus with switch 100B, two kinds of operations can be performed with one button 160 without the need to provide two kinds of switches, thereby simplifying the appearance. Further, a plurality of the levers 130 are fixed to the common substrate 114M. The FPC 120, the strain detecting element 125, and the PCB 140 are fixed to each lever 130. In this manner, the multidirectional input system with switch 200 includes a plurality of the multidirectional input apparatuses with switch 100 that are modularized, and, therefore, the assembly process when attaching the multidirectional input system with switch 200 to an electronic device can be simplified. When the multidirectional input system with switch 200 is used as a controller for a video camera, in addition to controlling the above-described operations of starting recording, zooming in and out (back and forth) to change the photographing magnification, and changing the microphone sensitivity, it is also possible to control a sub-camera (a camera that captures a direction or an angle of view that is different from that of a regular camera for wipe shooting) and the microphone sensitivity on the side of the photographer.

Figure 9:
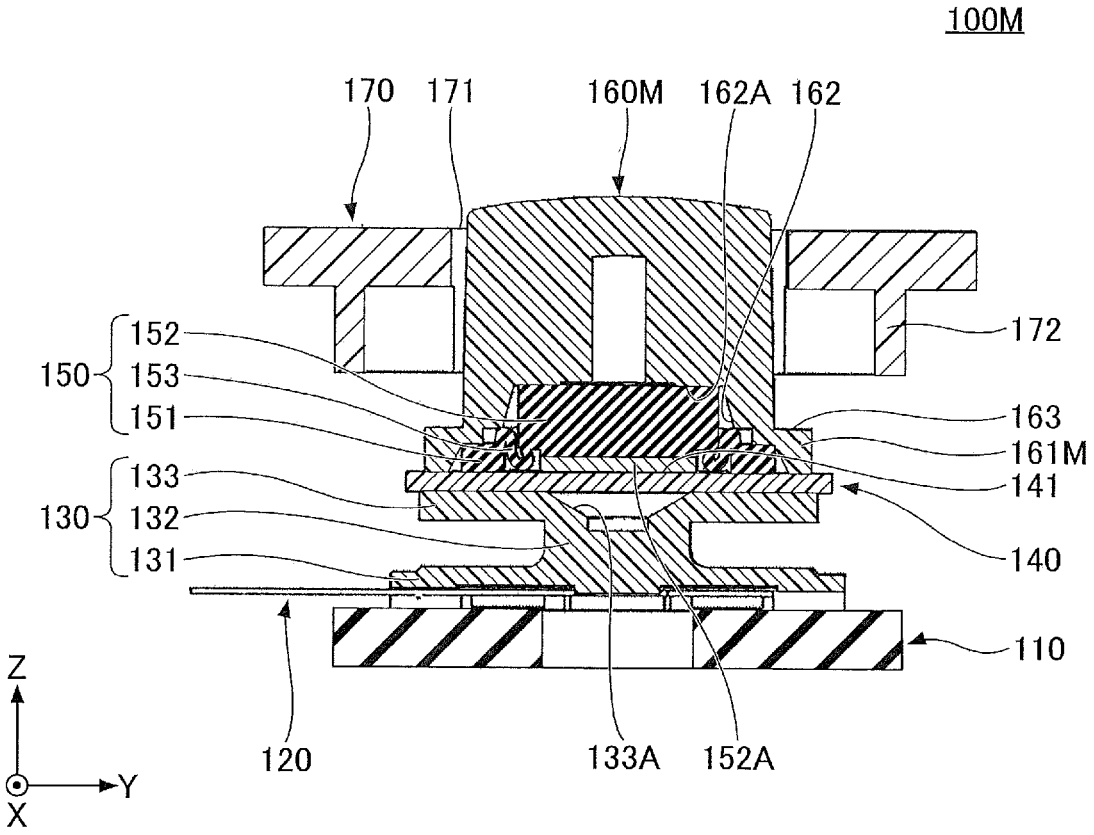
FIG. 9 is a diagram illustrating a multidirectional input apparatus with switch according to a modified example of the embodiment.

Further, although the configuration in which the protruding portion 161 of the button 160 presses the PCB 140 through the base portion 151 has been described above, the configuration may be as illustrated in FIG. 9. FIG. 9 is a diagram illustrating a multidirectional input apparatus with switch 100M according to a modified example of the embodiment. FIG. 9 illustrates a cross-sectional structure corresponding to FIG. 6.

The multidirectional input apparatus with switch 100M differs from the multidirectional input apparatus with switch 100 in that a button 160M is included in place of the button 160 illustrated in FIGS. 1 to 6. The button 160M differs from the button 160 in that, instead of the protruding portion 161 illustrated in FIGS. 1 to 6, the button 160M includes a protruding portion 161M and an engaging portion 163. The other configurations of the multidirectional input apparatus with switch 100M are similar to those of the multidirectional input apparatus with switch 100.

The engaging portion 163 is an annular portion that is outwardly protruding in the radial direction at the lower end of the outer peripheral surface of the button 160M. The button 160M is inserted through the opening portion 171 in the cover 170, and is therefore provided with the engaging portion 163 to prevent the button 160M from escaping upwardly from the opening portion 171 in the cover 170.

The protruding portion 161M is outside the base portion of the contact rubber 150 in planar view and is in direct contact with the upper surface of the PCB 140 as illustrated in FIG. 9. Thus, when the button 160M is completely pressed down, the protruding portion 161M directly presses the upper surface of the PCB 140. Even with the above configuration, similar to the multidirectional input apparatus with switch 100 of FIGS. 1 to 6, the operation of causing the electrode portions 141A and 141B to be electrically connected and the operation of selecting any direction in 360 degrees in the planar direction or a downward direction can be accomplished by operating a single button 160M. Therefore, there is no need to provide two switches, and downsizing is possible.

Thus, a downsized multidirectional input apparatus with switch 100M can be provided. Further, two kinds of operations can be performed with one button 160M, and it is not necessary to provide two switches, and, therefore, the appearance can be simplified.

Further, when the button 160 is pressed down completely, the protruding portion 161M can directly press the upper surface of the PCB 140, thus providing a rigid feel to a user who presses down the button 160 completely and then intends to further press the button 160 in a planar direction or a downward direction.

According to an aspect of the present invention, a multidirectional input apparatus with switch and a multidirectional input system with switch that are downsized, can be provided.

Although the multidirectional input apparatus with switch and the multidirectional input system with switch according to the embodiments of the present invention have been described as above, the present invention is not limited to specifically disclosed embodiments, and various modifications and changes may be made without departing from the scope of the claims.

What is claimed is:

1. A multidirectional input apparatus with a switch comprising:

a strain generating body including at least a cylindrical portion and a first plate portion provided under the cylindrical portion;

a plurality of strain sensors provided at the first plate portion;

a wiring substrate mounted on the cylindrical portion of the strain generating body;

a contact rubber mounted on the wiring substrate and configuring the switch together with an electrode on the wiring substrate; and a button mounted on the contact rubber, wherein the contact rubber includes a base portion positioned on a periphery of the contact rubber, a movable portion positioned at a center of the contact rubber, and a deformable portion linking the base portion and the movable portion, wherein the movable portion is movable to a first position with respect to the base portion in a state where the deformable portion is not deformed, and to a second position with respect to the base portion in a state where the deformable portion is deformed, a center of a lower surface of the button contacts an upper surface of the movable portion of the contact rubber when the movable portion is at the first position or the second position, and when the movable portion moves from the first position to the second position and a lower surface of the movable portion contacts the electrode on the wiring substrate, a protruding portion provided on a periphery of the lower surface of the button presses the wiring substrate.

2. The multidirectional input apparatus with the switch according to claim 1, wherein the protruding portion on the periphery of the lower surface of the button presses the wiring substrate through the base portion of the contact rubber.

3. The multidirectional input apparatus with the switch according to claim 2, wherein the movable portion of the contact rubber is thicker than the base portion of the contact rubber.

4. The multidirectional input apparatus with the switch according to claim 1, wherein the protruding portion on the periphery of the lower surface of the button is positioned on an outer side of the base portion of the contact rubber in a planar view, and directly presses the wiring substrate.

5. The multidirectional input apparatus with the switch according to claim 1, wherein the strain generating body further includes a second plate portion provided on the cylindrical portion, the wiring substrate is mounted on the second plate portion, and the protruding portion on the periphery of the lower surface of the button is provided at a position overlapping the second plate portion in a planar view.

6. The multidirectional input apparatus with the switch according to claim 1, wherein the electrode includes a first electrode portion and a second electrode portion divided by an S shape in a planar view, and the first electrode portion and the second electrode portion are electrically connected when the lower surface of the movable portion of the contact rubber contacts the first electrode portion and the second electrode portion.

7. The multidirectional input apparatus with the switch according to claim 1, wherein the contact rubber is formed by two-color molding, and includes a conductive rubber portion including carbon at a lower end of the movable portion.

8. The multidirectional input apparatus with the switch according to claim 1, wherein the button includes a recess portion configured to accommodate at least an upper portion of the movable portion of the contact rubber.

9. The multidirectional input apparatus with the switch according to claim 8, wherein a width of the recess portion is wider than a width of a portion of the movable portion to be accommodated within the recess portion.

10. The multidirectional input apparatus with the switch according to claim 1, further comprising:

a flexible wiring substrate provided under the first plate portion of the strain generating body and having the plurality of the strain sensors disposed thereon, wherein the plurality of the strain sensors are adhered to the first plate portion through the flexible wiring substrate.

11. The multidirectional input apparatus with the switch according to claim 10, wherein the plurality of the strain sensors are a plurality of resistive elements printed onto the flexible wiring substrate.

12. The multidirectional input apparatus with the switch according to claim 10, further comprising:

a holding portion configured to hold the strain generating element.

13. The multidirectional input apparatus with the switch according to claim 1, further comprising:

a cover configured to expose an upper end side of the button and to cover a lower end side of the button.

14. A multidirectional input system with a switch comprising:

a first multidirectional input apparatus with a switch; and a second multidirectional input apparatus with a switch, wherein each of the first multidirectional input apparatus with the switch and the second multidirectional input apparatus with the switch includes:

a strain generating body including at least a cylindrical portion and a first plate portion provided under the cylindrical portion;

a plurality of strain sensors provided at the first plate portion;

a wiring substrate mounted on the cylindrical portion of the strain generating body;

a contact rubber mounted on the wiring substrate and configuring a switch together with an electrode on the wiring substrate; and a button mounted on the contact rubber; and a common substrate configured to hold the strain generating body of the first multidirectional input apparatus with the switch and the strain generating body of the second multidirectional input apparatus with the switch, wherein the contact rubber includes a base portion positioned on a periphery of the contact rubber, a movable portion positioned at a center of the contact rubber, and a deformable portion linking the base portion and the movable portion, wherein the movable portion is movable to a first position with respect to the base portion in a state where the deformable portion is not deformed, and to a second position with respect to the base portion in a state where the deformable portion is deformed, a center of a lower surface of the button contacts an upper surface of the movable portion of the contact rubber when the movable portion is at the first position or the second position, when the movable portion moves from the first position to the second position and a lower surface of the movable portion contacts the electrode on the wiring substrate, a protruding portion provided on a periphery of the lower surface of the button presses the wiring substrate, and a plurality of the strain generating bodies, the plurality of strain sensors, a plurality of the wiring substrates, and the common substrate are fixed to each other.

15. The multidirectional input system with switch according to claim 14, further comprising:

a flexible wiring substrate provided under the first plate portion of the strain generating body of the first multidirectional input apparatus with the switch and under the first plate portion of the strain generating body of the second multidirectional input apparatus with the switch, and having the plurality of the strain sensors of the first multidirectional input apparatus with the switch and the plurality of the strain sensors of the second multidirectional input apparatus with the switch disposed thereon, wherein the plurality of the strain sensors of the first multidirectional input apparatus with the switch and the plurality of the strain sensors of the second multidirectional input apparatus with the switch are respectively provided at the first plate portion of the first multidirectional input apparatus with the switch and at the first plate portion of the second multidirectional input apparatus with the switch, through the flexible wiring substrate.

* * * * *